United States Patent [19]

Hare

[11] Patent Number: 4,980,224

[45] Date of Patent: Dec. 25, 1990

[54] TRANSFER FOR APPLYING A CREATIVE DESIGN TO A FABRIC OF A SHIRT OR THE LIKE

[75] Inventor: Donald S. Hare, New York, N.Y.

[73] Assignee: Foto-Wear, Inc., East Brunswick, N.J.

[21] Appl. No.: 215,774

[22] Filed: Jul. 6, 1988

Related U.S. Application Data

[63] Continuation-in-part of Ser. No. 819,605, Jan. 17, 1986, Pat. No. 4,773,953, and a continuation-in-part of Ser. No. 703,529, Feb. 20, 1985, abandoned.

[51] Int. Cl.[5] ..... B05D 1/14; B44C 1/17

[52] U.S. Cl. ..... 428/202; 428/352; 156/240; 156/289

[58] Field of Search ..... 428/40, 41, 42, 202, 428/352, 144, 145, 150, 147, 149; 427/146, 147, 148, 208.2, 208.8, 220, 221, 222; 156/230, 240, 289; 51/297, 301, 302, 306, 308

[56] References Cited

U.S. PATENT DOCUMENTS

| | | | |
|---|---|---|---|
| 4,142,929 | 3/1979 | Otomine et al. | 156/72 |
| 4,177,309 | 12/1979 | Shadbolt et al. | 156/230 |
| 4,308,310 | 12/1981 | Arnold et al. | 156/240 |
| 4,454,194 | 6/1984 | Luebbe, Jr. | 427/146 |

*Primary Examiner*—John J. Gallagher
*Assistant Examiner*—Louis Falasco

[57] ABSTRACT

A method and transfer sheet for transferring creative and personalized designs onto a tee shirt or similar fabric is described. The design can be created manually, electronically or a combination of both using personal computers, video cameras or electronic photocopiers. The transfer sheet includes a polymer-based iron-on transfer sheet supplied with an additional overcoating of resin mixed with abrasive particles. When cured, the abrasive particles in combination with the resin serve to enhance the receptivity of the transfer sheet to various inks and wax based crayons used in the creation and coloring of the designs.

4 Claims, 3 Drawing Sheets

TRANSFER FOR APPLYING A CREATIVE DESIGN TO A FABRIC OF A SHIRT OR THE LIKE

BACKGROUND OF THE INVENTION

This application is a continuation-in-part of U.S. application Ser. No. 819,605, filed on Jan. 17, 1986 now U.S. Pat. No. 4,773,953. U.S. application No. 819,605 is a continuation-in-part of U.S. application No. 703,529 filed on Feb. 20, 1985, now abandoned.

The present invention relates to a method for electronically and manually creating graphics, images or creative designs on a fabric. More specifically, the present invention relates to a method of creating personalized graphics, images or other creative designs using an electronic device such as a personal computer or photocopier and thereafter transferring those graphics, images or designs to a fabric such as a tee shirt or the like.

In recent years, tee shirts with a variety of designs thereon have become very popular. A large number of tee shirts are sold with pre-printed designs to suit the various tastes of consumers. In addition, many customized tee shirt parlors have appeared, particularly in resort areas, which permit customers to select designs of their choice. Processes have also been proposed for permitting customers to create their own designs on transfer sheets for application to tee shirts by use of a conventional iron, such as described in U.S. Pat. No. 4,224,358, issued Sept. 23, 1980, to the present inventor.

Simultaneous with the development of the tee shirt rage, there is a growing popularity for equipment and processes for creating personalized graphics or designs. Many products are available for permitting such graphics or designs to be created, including video cameras; keyboards, "mice", joysticks, light pens or other input devices used with personal computers; and electronic photocopier machines.

Printers have conventionally used two alternative methods for creating designs for iron-on transfers. However, neither method has been effective in the creation of personalized designs because of both the cost associated with the method or the poor image reproduction.

First, many iron-on transfer designs are made with conventional type printing presses. Such methods include litho, offset and screen printing. These methods are impracticable because of the high cost associated with creation of the design unless several transfers are created. Thus, this method is ill-suited for creating unique personalized designs.

Second, some personalized iron-on transfers are created using sublimation ribbons to replace standard ribbons used with dox matrix impact printers. However, this method produces a low quality image.

SUMMARY OF THE INVENTION

It is primary object of the present invention to provide a product and a method which will attract the interest of consumer groups which are already captivated by the tee shirt rage described above; as well as the creative graphics rage utilized in connection with personal computers; video cameras; photocopiers and other electronic devices for creation of personalized designs.

Accordingly, it is an object of the present invention to provide a method permitting the creation of personalized designs, images or graphics either manually or using an electronic device; printing of the design, images or graphics so created on a transfer sheet; and ironing of the personalized designs or graphics on the transfer sheet onto a conventional tee shirt or other fabric.

It is a further object of the present invention to provide a method which enlarges the present uses of graphic techniques developed for personal computers.

It is another object of the present invention to provide an improved transfer sheet which is receptive to the inks used in personal computers.

It is still another object of the present invention to provide a method which creates a more entertaining way to make one's own personalized tee shirt than known heretofore, through conventional, manual operations.

It is yet another object of the present invention to provide a new form of entertainment for personal computers and other electronic devices such as photocopiers and video cameras.

It is still another object of the present invention to provide a method which can be practiced in a coin-operated, arcade environment to permit customers to electronically create their own personalized tee shirts through a coin-operated computer system containing the required graphics capabilities.

The objects of the present invention are fulfilled by providing a method for applying a creative design image or graphics to a fabric or a shirt, or the like, comprising the steps of:

(a) generating said image on an obverse surface of a transfer sheet, said transfer sheet including a substrate with a first coating thereon transferable therefrom to said fabric by the application of heat or pressure, and a second coating on said first coating, said second coating defining said obverse face and consisting essentially of a mixture of resin and abrasive particles to form an abrasive surface for increasing the receptivity of the transfer sheet;

(b) positioning that obverse surface of said transfer sheet against said fabric; and (c) applying energy to the rear of said transfer sheet to transfer said image to said fabric.

The image may be electronically generated by a video camera or a photocopier, so the image may be a picture of one self or a family member, which may be printed on a fabric.

The steps of electronically generating the creative design may also be performed by manually manipulating a cursor across the screen of a visual monitor to create the design, the pattern of movement of the cursor being stored in the memory of an associated personal computer, to enable the pattern to be displayed on a cathode ray tube thereof.

The electronic manipulation of the cursor may be performed on a "Koala Pad", by a "mouse", "joystick", keys on a keyboard, light pen, or by moving one's finger across a touch-sensitive, monitor screen.

The printer utilized may be a multi-color printer or one that simply prints black on white. In the latter case, the creative design would comprise only the outline or shapes of objects and color could be added directly to the transfer sheet following printing by the printer, by the use of heat-transferable, color crayons, such as ordinary was crayons (e.g., CRAYOLA), permanent markers, or oil-base paints.

Various conventional printers can be used to achieve quality results including laser printers and impact dot matrix printers.

Additionally, an electronic photocopier can also be used to create either a black on white or color image on the transfer sheet.

If a message is to be included in the creative design, such as a word of the alphabet, software may be provided within the personal computer which permits the image created on the screen to be horizontally reversed. The reversed image would then be transferred to the printer and printed in reverse form onto the transfer sheet. One could then simply iron from the back of the transfer sheet and transfer the original, unreversed image from the screen directly onto the fabric of the tee shirt or the like.

BRIEF DESCRIPTION OF THE DRAWINGS

The present invention will become more fully understood from the detailed description given hereinbelow, and the accompanying drawings which are given by the way of illustration only, and thus are not limitative of the present invention, and wherein:

FIG. 5 illustrates the step of ironing the design created on the transfer sheet onto a tee shirt or the like.

DETAILED DESCRIPTION OF PREFERRED EMBODIMENTS

Figure 1:
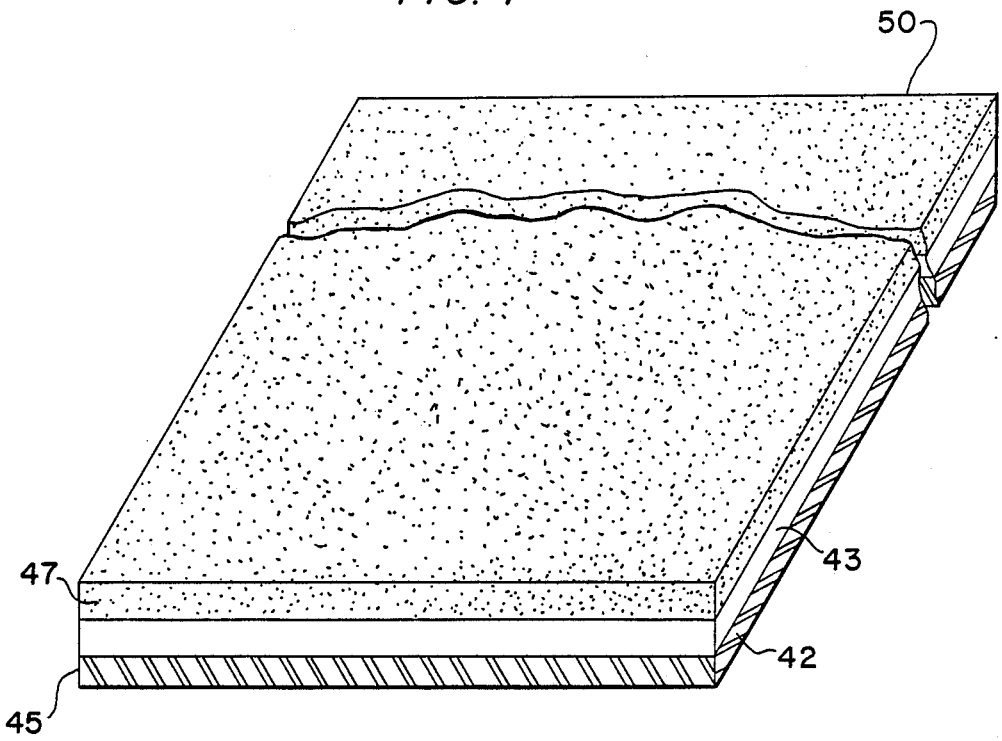
FIG. 1 is a sectional side view of a transfer sheet.

As shown in FIG. 1, a preferred embodiment of the transfer sheet 50 comprises, in part, a transfer paper manufactured by Kimberly-Clark Corporation under the trademark "TRANSEEZE". Any other commercially-available transfer sheet may be utilized which has a substrate with a coating which is transferable to a receptor sheet upon the application of heat or pressure to the back of the substrate. It is a discovery of the present invention, however, that the transferable coating of "TRANSEEZE", and other commercially-available transfer sheets, are not sufficiently receptive, or absorbent with respect to either the inks normally used in computer-type printers or ordinary wax crayons (e.g. CRAYOLA) to facilitate the printing-coloring of a good-quality, clearly recognizable image or the transfer sheet and the subsequent transfer of the image to a fabric. This problem has been solved in accordance with the present invention by coating the transferable layer of conventional transfer sheets with an overcoating of resin mixed with abrasive particles in a manner described in the following Example.

EXAMPLE

The transfer layer 43 of a transfer sheet 50, comprised of latex saturated paper with a polymer coating of polyethylene base, such as "TRANSEEZE" manufactured by Kimberly-Clark Corporation, may be spray-coated or applied via commercial offset or litho printers with an overcoating of resin mixed with abrasive particles. The entire transfer sheet 50, including the substrate 42, heat transferable coating 43 and overcoating 47, may then be run through a hot air drier to remove tackiness. This will permit stacking and slip-sheeting of the resulting products.

The overcoating 47 of the transfer sheet 5 includes a mixture of resin with abrasive particles. The abrasive particles are added to the resin in order to form an abrasive surface on the face of the transfer sheet once the drying process is complete. The abrasive surface serves to enhance receptivity of the transfer paper to deposits of color from thermal ribbon printers or ordinary wax crayons.

In one embodiment, an overcoat 47 of Singapore Dammar Resin mixed with very fine sugar granules has been found by the present inventor to exhibit excellent receptivity and non-smudge characteristics with respect to a wide variety of commercially-available printing inks utilized in state-of-the-art computer printers. The transfer sheet of the present invention has been successfully tested with the inks used in computer printers, such as the OKIMATE 10 by OKIDATA, and the TOSHIBA 5400; thermal ribbon transfer printers using wax-based pigment inks on polyester ribbon substrates. Successful tests has also been performed using dot matrix printers with matrix inks or nylon ribbon, such as used in the entire line of Epson and IBM printers and modern laser printers.

In a second embodiment, white silica sand can be used as abrasive particles with resin to form the overcoating 47.

The overcoating 47 is also receptive to wax-based crayons, permanent markers, and oil paints, so it may be readily hand-colored as described hereinbelow.

Figure 2:
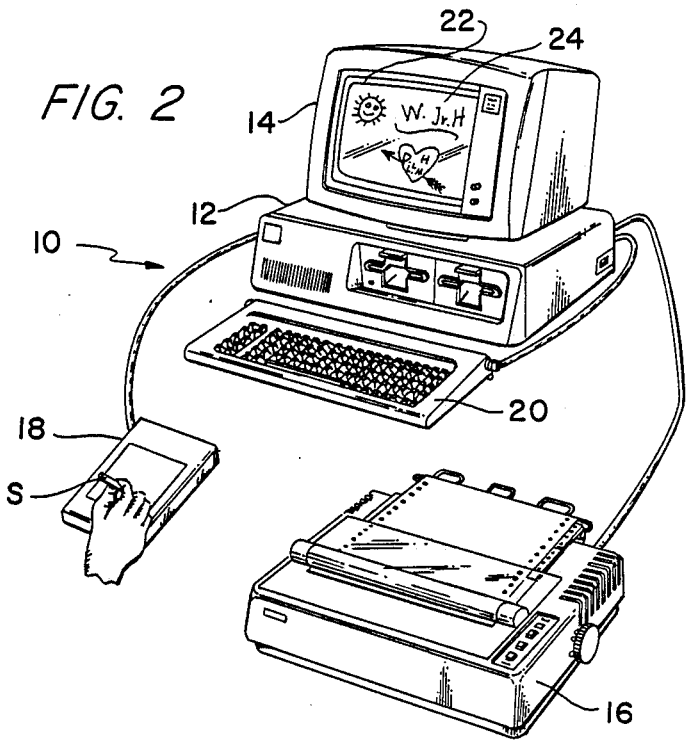
FIG. 2 is a diagrammatic illustration of an exemplary personal computer system which might be used for practicing the method of the present invention.

Referring in detail to FIG. 2, there is generally illustrated a personal computer system which may be utilized for practicing the method of the present invention. This computer system is generally illustrated 10, and includes a central processing unit (CPU) 12 of any commercially-available type such as an IBM PC, an APPLE MCINTOSH, or any other suitable type. The computer system further includes a monitor 14 having a display screen 22, a keyboard 20, and a matrix/graphics printer 16 Printer 16 may be any commercially-available printer, and in a preferred embodiment is a "OKIMATE 10", manufactured by Okidata Company, which is capable of printing graphics in approximately twenty-six colors. The computer system 10 further includes a graphics input pad 18 such as a "KOALA PAD TOUCH TABLET" manufactured by Koala Technologies. This graphics input pad permits one to create, by hand, any desired pattern on the pad by means of a stylus "S" and the pattern so created on the pad is electronically transferred through an appropriate cable to the screen of monitor 14 through the CPU 12.

As further illustrated in FIG. 2, the creative design or pattern being created on graphics input pad 19 is the design 24 illustrated on screen 22, including an illustration of a smiling sun in the upper left-hand corner, and a heart with an arrow through it bearing appropriate initials. This design 24 is illustrated in more detail in the enlarged view of FIG. 2.

It should be understood that this design 24 can be created on screen 22 by various means other than the graphics input pad 18. For example, it could be created by use of a well-known "mouse" which is also electronically coupled to the CPU 12; a "joy stick" electrically coupled to the CPU 12; by means of keys on the keyboard 20; a hand-held light pen which is moved across the face of screen 22; or screen 22 may be a touch sensitive screen so that a pattern may be created thereon by movement of one's finger across the screen.

In the preferred embodiment where the KOALA GRAPHICS INPUT PAD is utilized, this device has the capability of selecting colors for portions of the pattern created. For example, if the outline of the sun with the face is to be orange, an appropriate color selection key would be actuated in the control position of pad 18. Likewise, the internal portion of the sun symbol could be colored a solid yellow, and the background around the sun could be colored sky blue. Of course, the colors selected by pad 18 would be appropriately displayed in those colors on the screen 22 and the same color selection information would be transferred to the printer 16 so that the final image printed on transfer paper 50, to be described hereinafter, would be printed thereon in inks of the selected colors for the corresponding portions of the design of pattern.

In an alternative embodiment, it may be desirable to merely draw the outline in black and white of the pattern 24, print the same on transfer sheet 50 with the aid of printer 16, and then handcolor the transfer sheet 50 with heat-transferable, colored crayons, such as ordinary wax crayons (e.g., CRAYOLA), permanent markers, or oil paints which then become transferable with heat, to achieve a transfer pattern of a desired color distribution.

Figure 3:
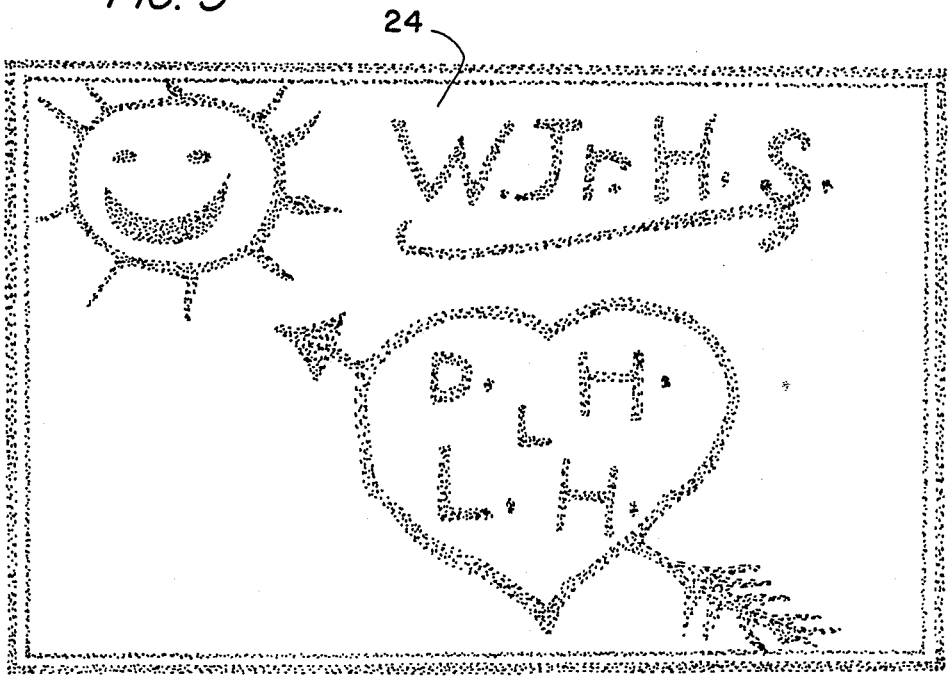
FIG. 3 is an enlarged view of the exemplary, personalized, creative design illustrated on the monitor screen in the system of FIG. 1.
Figure 4:
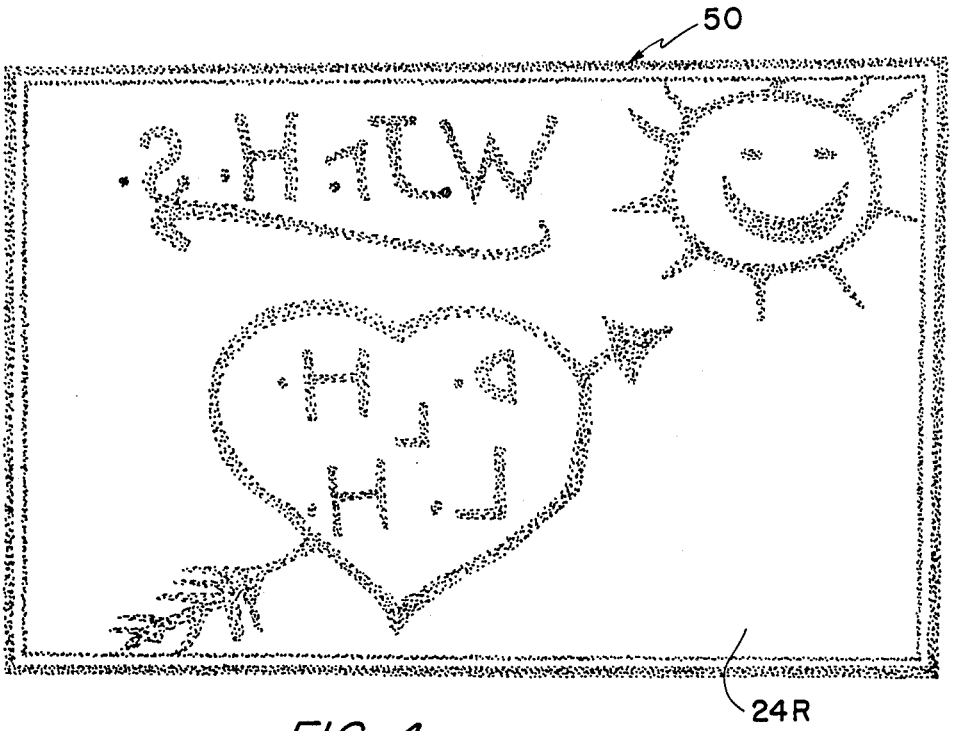
FIG. 4 illustrates a transfer sheet printed with the design created on the screen of FIG. 1 with the message thereon horizontally reversed.

When it is desired to create alphabetical message, such as "W.Jr. H.S.", as part of the design 24, it is necessary to have some means of reversing the image from left to right within the CPU 12 before it is printed onto the transfer sheet 50 by printer 16. This is best illustrated by the combination of the illustration in FIGS. 3 and 4. FIG. 3 shows the image of the design 24 as it appears on screen 22 of monitor 14 and FIG. 4 shows the design 24 as it would be printed as a reverse image on transfer sheet 50. The purpose of reversing the image from left to right, or vice versa, is so that when one applies a source of heat energy, such as from an iron, to the backside 50A of transfer sheet 50, the image which is transferred to a tee shirt or fabric 62 is the reverse image of that of FIG. 4, which corresponds to the same image that was originally created on screen 22 of monitor 14. This horizontal flip or image reversal within the CPU 12 may be easily accomplished by commercially-available software to make it possible to create alphabetical messages on the surface of fabrics without writing the message backwards initially, such as by means of stylus "S" on the graphic input pad 18.

Figure 5:
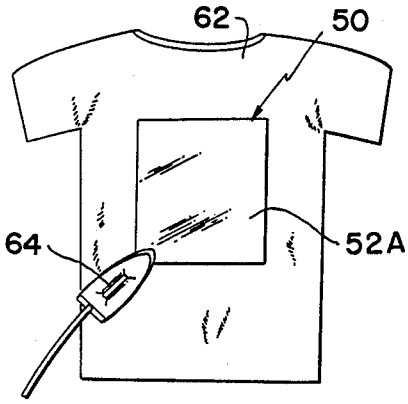

FIG. 5 illustrates how the final step of heat transfer from transfer sheet 50 to a tee shirt or fabric 62 is performed. The tee shirt 62 is laid flat, as illustrated, on an appropriately colored, either by preselection of colors, by use of the graphics input pad 18 and the associated controls in conjunction with the multi-color printing capability of printer 16, or the colors of design 24 on tee shirts 62 may be the result of hand-coloring a black and white outline which was printed on transfer sheet 50.

Figure 6:
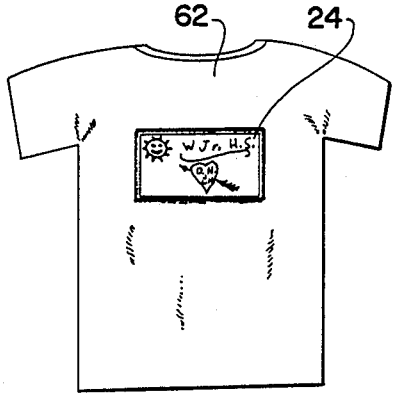
FIG. 6 is an illustration of the final design as it would appear on a tee shirt.

FIG. 6 illustrates the completed transfer of the personalized design onto a tee shirt.

An alternative method for creation of a design using the disclosed transfer sheet is with electronic photocopiers. An image, photograph, outline or picture can be electronically reproduced on the transfer sheet 50 either black on white or in multi-color. Similar to the computer printer inks and wax based crayons, the transfer sheet is equally receptive to photocopier toners. Once printed, the image can then be colored or modified manually to add personalized additions.

The invention being thus described, it may be obvious that the same may be varied in many ways. Such variations are not to be recorded as a departure from the spirit and scope of the invention, and all such modifications as would be obvious to one skilled in the art are intended to be included within the scope of the following claims.

What is claimed is

1. A transfer sheet consisting of:

(a) a substrate;

(b) first coating on said substrate of material transferable from said substrate to a receptor surface by the application of heat or pressure thereto; and (c) a second coating on said first coating, said second coating consisting essentially of a mixture of Singapore Dammar resin and abrasive particles to form an abrasive surface for increasing receptivity of the transfer sheet.

2. The transfer sheet of claim 1 wherein said abrasive particle of said second coating are sugar granules.

3. The transfer sheet of claim 1 wherein said abrasive particles of said second coating are white silica sand.

4. A transfer sheet comprising:

(a) a substrate;

(b) first coating on said substrate of material transferable from said substrate to a receptor surface by the application of heat or pressure thereto; and (c) a second coating on said first coating, said second coating consisting essentially of a mixture of resin and sugar granules to form an abrasive surface for increasing receptivity of the transfer sheet.

* * * * *